US005537758A

United States Patent [19]

Guarise

[11] Patent Number: 5,537,758

[45] Date of Patent: Jul. 23, 1996

[54] DRIER FOR THE CONTINUOUS DRYING AND CONDITIONING TREATMENT OF HIDES FABRICS

[75] Inventor: Angelo Guarise, San Pietro Di Rosa, Italy

[73] Assignee: Baggio Tecnologie SRL, Bassano Del Grappa, Italy

[21] Appl. No.: 356,376

[22] PCT Filed: Jun. 27, 1994

[86] PCT No.: PCT/EP94/02086

§ 371 Date: Dec. 27, 1994

§ 102(e) Date: Dec. 27, 1994

[87] PCT Pub. No.: WO95/01540

PCT Pub. Date: Jan. 12, 1995

[30] Foreign Application Priority Data

Jun. 30, 1993 [IT] Italy ..... VI93A0112

[51] Int. Cl.[6] ..... F26B 19/00

[52] U.S. Cl. ..... 34/216; 34/217; 34/550; 34/560

[58] Field of Search ..... 34/216, 217, 207, 34/550, 560

[56] References Cited

U.S. PATENT DOCUMENTS

| | | | |
|---|---|---|---|
| 3,096,162 | 7/1963 | Pepson | 34/216 |
| 4,479,310 | 10/1984 | Duc | 34/560 |
| 4,567,673 | 2/1986 | Bohnensieker | 34/216 |
| 5,050,318 | 9/1991 | Du Bruyn | 34/217 |
| 5,319,862 | 6/1994 | Ohgihara | 34/216 |
| 5,400,570 | 3/1995 | Bennett | 34/216 |

FOREIGN PATENT DOCUMENTS

| | | |
|---|---|---|
| 0055787 | 7/1982 | European Pat. Off. . |
| 2538887 | 7/1906 | France . |
| 2551538 | 3/1908 | France . |
| 2368000 | 6/1916 | France . |
| 0356388 | 2/1928 | Germany . |
| 360353 | 2/1962 | Switzerland . |
| 390270 | 4/1933 | United Kingdom . |
| 541701 | 12/1941 | United Kingdom . |
| 609122 | 9/1948 | United Kingdom . |
| 684738 | 12/1952 | United Kingdom . |

*Primary Examiner*—John T. Kwon
*Attorney, Agent, or Firm*—Watson Cole Stevens Davis

[57] ABSTRACT

A drier for the continuous drying and conditioning treatment of hides and fabric products has a drying chamber having first and second areas, a loading unit for conveying product to the first area, a conveyor for transporting product from the first area to the second area and an unloading belt for conveying material out of the second area. The drier has a first heater and humidity control for heating and circulating air in the first area and a second heater and humidity control for heating and dehumidifying air circulated in the second area. The second heating and humidifying control includes a heat pump which has a compressor and a refrigeration circuit and a heating and condensing battery. Water saturated air is circulated through the condensing battery in heat exchange relation with the refrigeration circuit for removing water saturated air from the second area and delivering the air to the heating battery which reheats the air for circulation back into the second area.

15 Claims, 5 Drawing Sheets

DRIER FOR THE CONTINUOUS DRYING AND CONDITIONING TREATMENT OF HIDES FABRICS

BACKGROUND OF THE INVENTION

1. Field of the Invention

The invention concerns an improved drier for the continuous drying and conditioning treatment of hides or fabrics.

2. General State of the Art

It is a known fact that the drying and conditioning treatment of hides or fabrics, is carried out by means of driers, essentially consisting of a drying chamber into which the products are inserted and which is provided with a system for heating and dehumidifying.

In particular, a continuous drier for hides being the object of the international registered No. 93/00654 in the name of same inventor is known, wherein the hides are inserted into a drying chamber through a loading unit, said drying chamber presenting a plurality of drying belts, overlying another and receiving in succession the hides coming from the loading unit.

At the end of the run of the drying belts, an unloading belt conveys the dried hides to the exterior.

Said system is provided with a high-frequency unit for monitoring the humidity, and therefore for conditioning the expelled hide, and with a heating and dehumidifying system consisting of a heat pump in the drying chamber.

One inconvenience that said drier presents is that the use of a heat pump for obtaining the heating and the dehumidification of the drying chamber, and therefore of the hides, is very costly.

In fact, since the hides loaded into the drier contain humidity amounting to about 50% in weight, it is clear that it becomes very costly to eliminate such a great quantity of water by using a heat pump for the drying and dehumidifying process, considering that its optimum performance is achieved around 35°–37° C. and, therefore, requires rather long drying times.

SUMMARY OF THE PRESENT INVENTION

The purpose of the present invention is to overcome such an inconvenience by obtaining a drier provided with an improved drying and dehumidifying unit which permits to reduce the drying times of the hides, as compared with the driers belonging to the known technique.

Another purpose is that such a drying and dehumidifying treatment can be obtained at a low cost.

The described purposes are achieved by means of a drier for the continuous drying and conditioning treatment of hides or fabrics which, in accordance with the main claim comprises:

- a loading unit consisting of a plurality of belts suited to convey the product to be treated inside a drying chamber;
- a drying chamber within which there is a plurality of drying belts, suited to receive the material conveyed by the loading unit;
- an unloading belt which conveys the material outside the drier once the treatment has been completed;
- means for dehumidifying and conditioning the product; and is characterized in that said drying chamber is subdivided into a first area communicating with first means for heating and dehumidifying the air circulating in said first area and into a second area communicating with second means for heating and dehumidifying the air circulating in said second area.

According to one preferred embodiment said first heating and dehumidifying means consist of a heating battery, fed by any kind of hot fluid and thermofrozen by means of an electronic control unit provided with feelers for monitoring the temperature and the humidity.

Said second means for heating and dehumidifying the air consist instead of a heat pump comprising a compressor which keeps a refrigerating fluid in circulation inside a closed circuit connected both with a condensing battery for dehumidifying the air and with a heating battery for heating the air itself.

Advantageously then, the drier according to the invention permits to obtain a better monitoring of the humidity on the finished product.

Moreover, energy saving is advantageously obtained, with drying times being shorter as compared with the times necessary to the driers belonging to the known technique.

Further scope of applicability of the present invention will become apparent from the detailed description given hereinafter.

BRIEF DESCRIPTION OF THE DRAWINGS

However, it should be understood that the detailed description and specific example, while indicating a preferred embodiment of the invention, are given by way of illustration only, since various changes and modifications within the spirit and scope of the invention will become apparent to those skilled in the art from this detailed description and from the drawings, wherein.

DESCRIPTION OF THE PREFERRED EMBODIMENT

Figure 1:
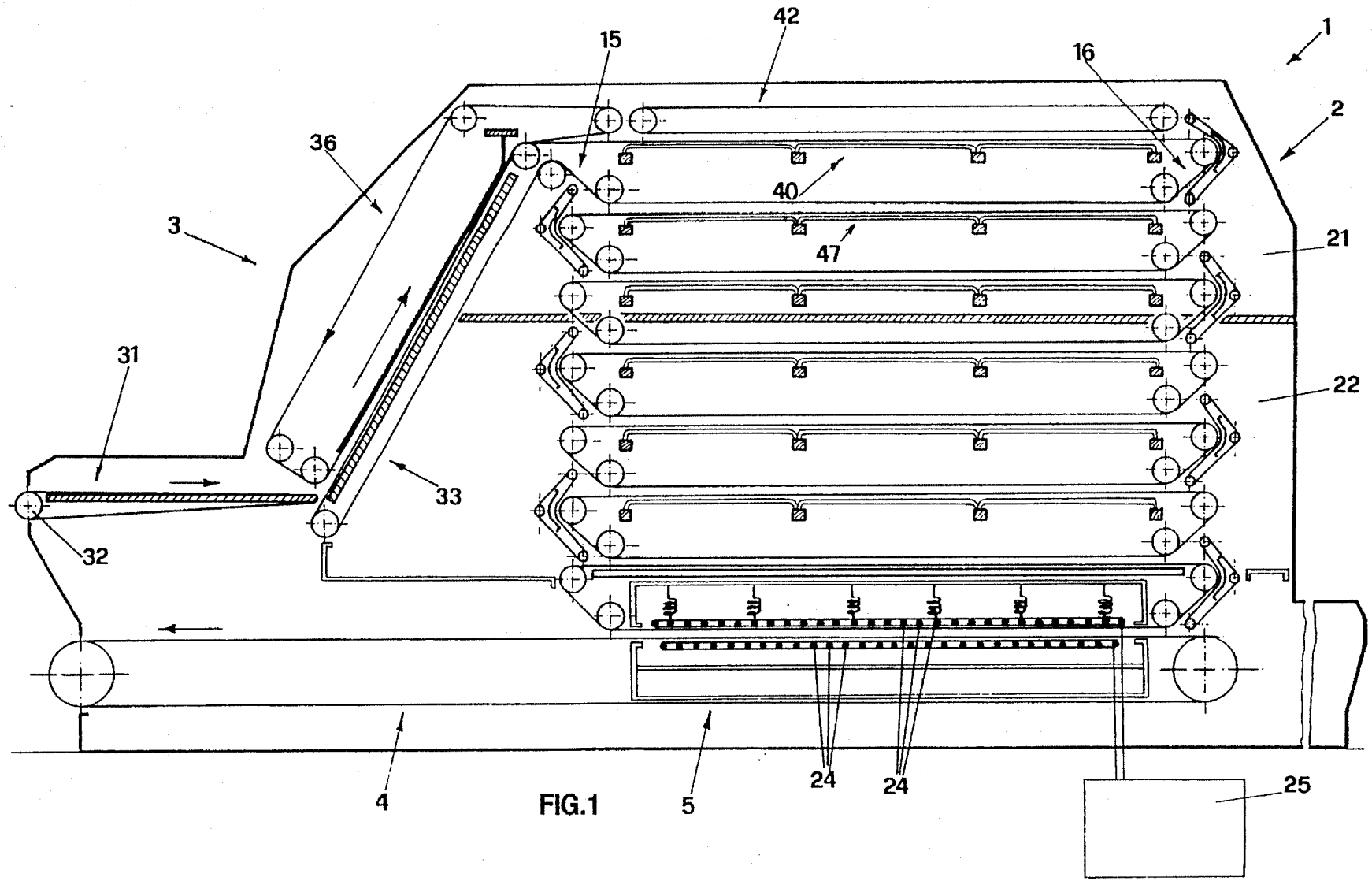
FIG. 1 represents the drier according to the invention in a lateral cutaway view.

The drier according to the invention, as can be observed in FIG. 1, wherein it is indicated as a whole with 1, comprises a drying chamber, indicated as a whole with 2, which is subdivided into a first chamber 21 and a second chamber 22.

The drier presents a loading unit in its front end, indicated as a whole with 3, through which the hides to be dried are inserted into the drying chamber, and an unloading belt 4 at the bottom, through which the dried hides are conveyed to the exterior from the loading side or from the opposite side, according to need.

The drier comprises also a high-frequency unit, indicated as a whole with 5, which is used for monitoring the humidity of the hide.

Figure 5:
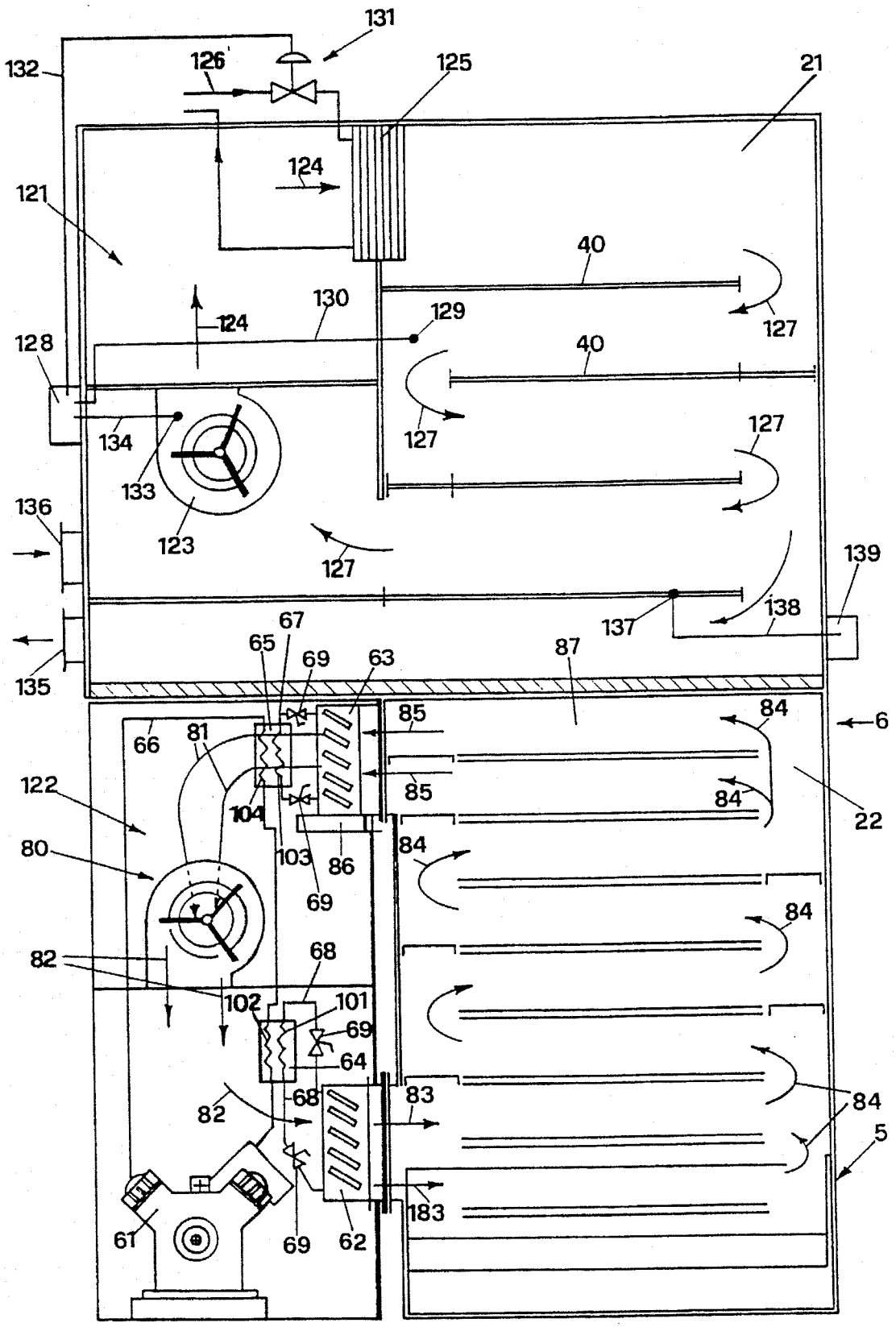
FIG. 5 represents a transversal section of the drier of FIG. 1 with the heating and dehumidifying means in a schematic view.

Moreover, as it can be observed in FIG. 5, the heating and dehumidifying means, indicated as a whole with 6, belong also to the drier 1, and they have the purpose of both heating the air drying the hides and of removing the steam produced inside the drying chamber 2 during the treatment.

It is made clear that in one different embodiment the high-frequency unit 5 may be omitted.

Figure 3:
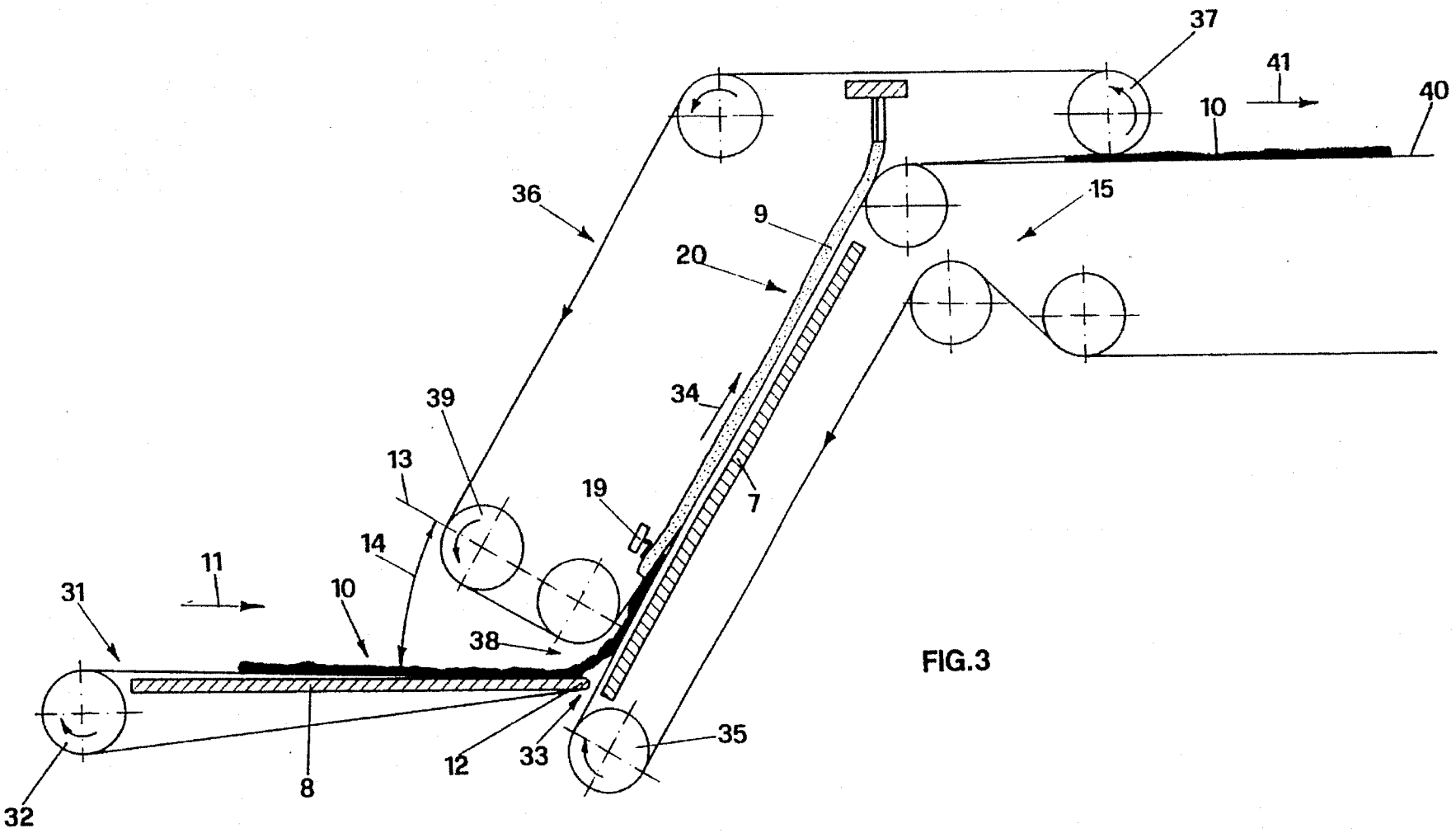
FIG. 3 represents the detail of the loading unit of FIG. 1.

The loading unit indicated as a whole with 3 is represented in FIG. 1 and more in particular also in FIG. 3, wherein it can be observed that it consists of an inlet belt 31 arranged at an essentially horizontal position, over which the hide to be dried 10 is laid, said belt is caused to advance at a pre-set speed following direction 11 by the motorized cylinder 32.

The inlet belt 31 slides over a flat supporting surface 8, whose extremity 12 has a round shape so as to act as a transmission element 8 for the motorized cylinder 32 of the inlet belt 31.

This belt then conveys the hide 10 toward a feeding belt 33, always belonging to the loading unit 3, which slides over a firm flat contrasting surface 7 and is caused to advance following direction 34 because of the rotation of the motorized cylinder 35 over which it is wound.

A feeding counter-belt 36, associated with the feeding belt 33 and placed opposite to it, advances following the same direction 34 and at the same speed as the feeding belt 33 driven by at least one of the cylinders over which said counter-belt is wound.

The feeding counter-belt 36 is made of soft and elastic material so as to adjust itself to the superficial shape of the hide thus keeping it stretched out and driving it all along its run, until it is inserted into the drying chamber.

Between the feeding belt 33 and the counter-belt 36 facing it, an interspace is created, in the middle of which is held the hide 10 coming from the inlet belt 31.

The advancement speed following direction 34 of the feeding belt 33 is higher than the advancement speed of the inlet belt 31, so that the hide 10 during the passage from the inlet belt 31 to the feeding belt 33 is drawn by the latter with a tension which is proportional to the speed difference between the belts. Thus the hide is kept under tension and is, therefore, perfectly stretched out.

It can also be observed that in correspondence with the area 38, wherein the hide 10 is transferred from the inlet belt 31 to the feeding belt 33, the feeding counter-belt 36 stretches out between a pair of cylinders 39 whose centres are aligned along a direction 13 which forms, in relation to the horizontal surface, an angle 14.

The value of such an angle 14 and the diameter of the cylinders 39 have such dimensions as to create in the area 38 the conditions necessary for the transfer to occur with a sufficiently soft bending movement, such as to avoid the formation of creases.

Figure 2:
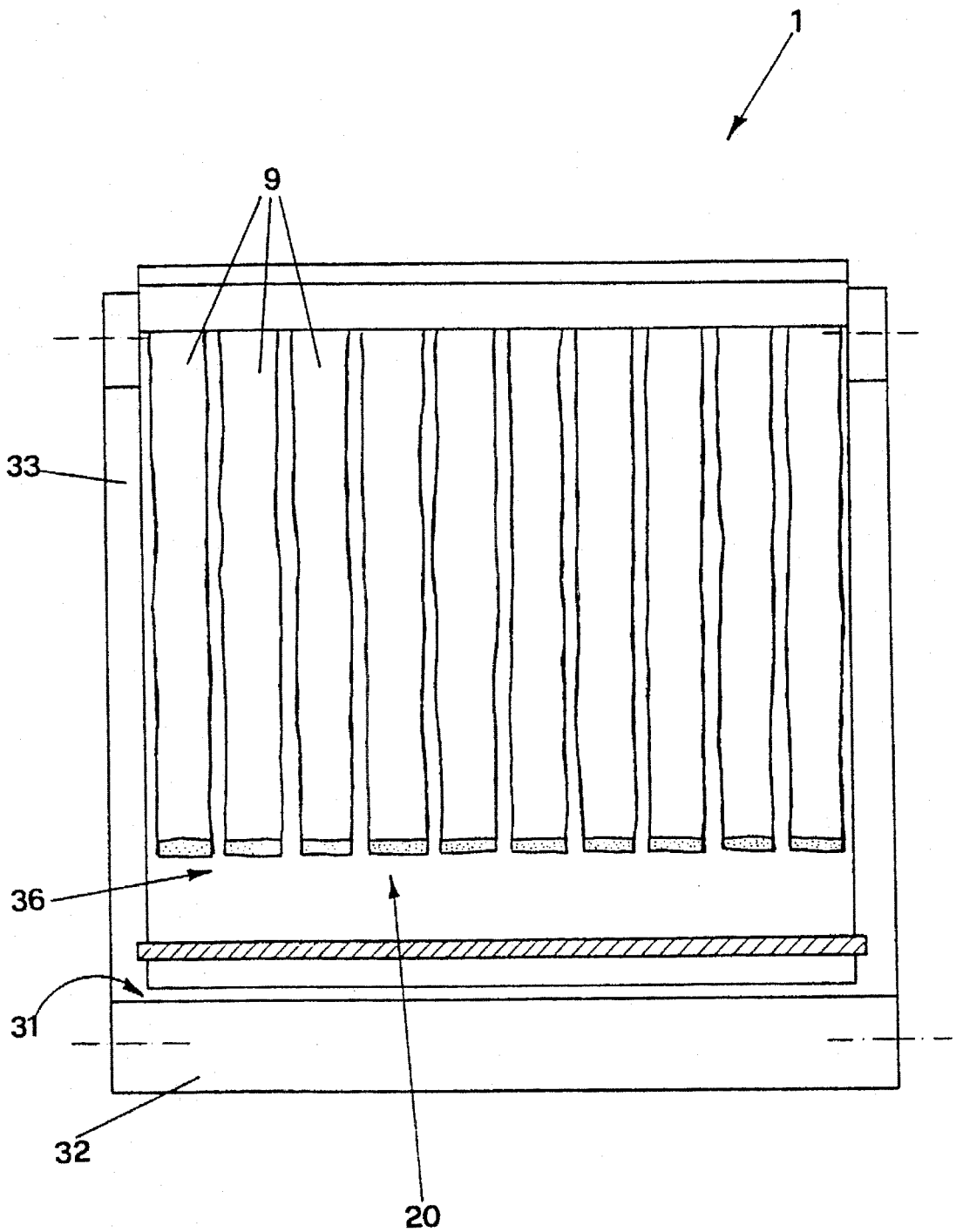
FIG. 2 represents the front view of the drier of FIG. 1.

The feeding counter-belt 36, as can be observed in FIG. 2 and in FIG. 3, is kept adhering to the hide 10 and therefore, also to the feeding belt 33 because of the presence of pressure elements 20 consisting of a plurality of elastic ribbons 9 which exert a constant pressure uniformly distributed all over the surface of the hide and which prevents the latter from receding.

Said ribbons are attached to the upper part of the loading unit 3 and position themselves by gravity on the counter-belt 36. As an alternative to the ribbons some chains can be used.

Said ribbons are also bound in the final part through a stopping element 19 which is attached to the structure of the loading unit 3 itself and has the function of preventing the accidental dragging of the ribbons caused by the counter-belt 36 during its motion.

The action of the pressure exerted by the elastic ribbons 9 is uniformly distributed all over the surface of the hide, and is made more effective because of the characteristics of softness of the feeding counter-belt 36.

When the hide 10 has reached the final part of the feeding belt 33, it is driven toward the bottom by the feeding counter-belt 36 and by the corresponding expelling cylinder 37, thus it is forced to meet the first drying belt which is arranged in a horizontal position and wound in the shape of a ring around a group of three inlet cylinders 15 and a pair of expelling cylinders 16, particularly visible in FIG. 1, and which is made to advance following direction 41 because of the rotation of said cylinders around which it is wound.

From this moment the hide being treated 10 starts its course inside the drying chamber 2, without having been subjected to any violent pressure between the cylinders and the belts.

Therefore, the formation of creases is avoided, whereas the presence of possible wrinkles has been eliminated by the stretching exerted by the different speeds of the belts. As can be observed in FIG. 1, the hide under treatment is kept adhering to the first drying belt 40 by a drying counter-belt 42 arranged on top of the drying belt 40.

Figure 4:
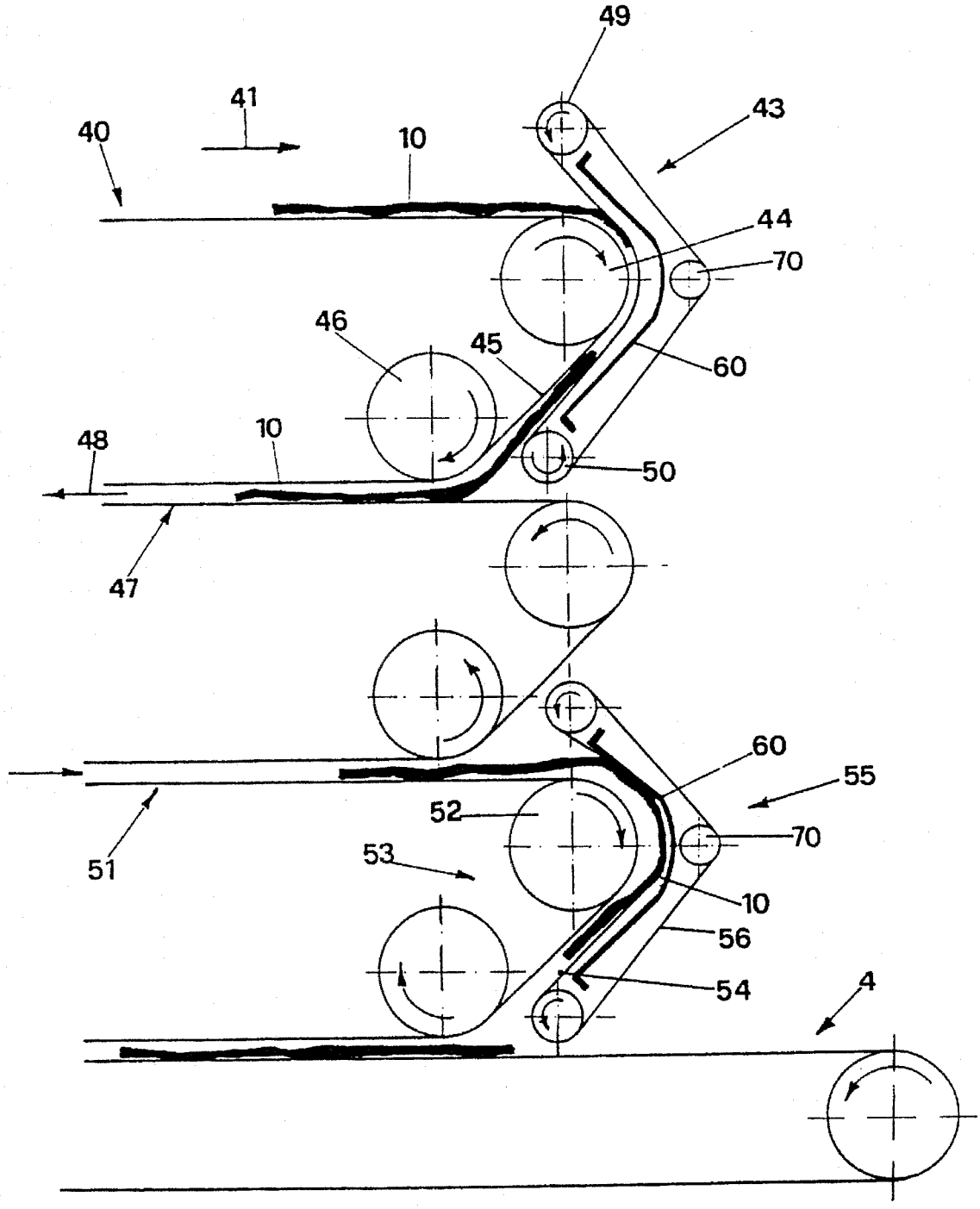
FIG. 4 represents the details of some deflecting belts, each of them placed at the hide-unloading end of its corresponding drying belt.

When the hide 10 reaches the end of said first drying belt 40, as can be observed in FIG. 4, it meets the deflecting belt 43 which wraps with a moderate pressure—thus avoiding the formation of creases on the hide—the drying belt 40 on the upper cylinder 44 belonging to the pair of expelling cylinders 16 and also drives it for a part of its descending movement 45.

The deflecting belt 43 acts in this way as a guide for the hide 10 until it reaches the lower cylinder 46 in correspondence of which the hide is placed over a second drying belt 47, completely similar to the previous one, which causes the hide to advance following direction 48, opposite to the previous direction 41.

The deflecting belt is made of elastic and soft material so that it is able to perform an optimum function of guiding the hide 10 being treated and of checking the pressure exerted on it.

In particular, it can be observed in FIG. 4 that the deflecting belt 43 is wound around an upper cylinder 49, a lower cylinder 50 and an intermediate cylinder 70.

Since said cylinders are arranged further back than the upper cylinder 44 of the drying belt 40, the upper cylinder 49 allows the hide to be gently inserted between the first drying belt 40 and the deflecting belt 43, whereas the lower cylinder 50 acts as a guide for the hide 10 at the moment when said hide separates from the contact between the previous belts and starts placing itself over the second drying belt 47.

Moreover, the lower cylinder 50 guides the hide 10 during its whole phase of stretching over the second drying belt 47 until it has completely separated from the previous belts.

The intermediate cylinder 70, instead, performs only a guiding function of the deflecting belt.

During its course over the drying belts, the hide has a tendency to become stiff because of the drying action and, therefore, it presents ever more difficulty in adapting to the bending action of the expelling cylinders of the drying belt, in particular to the bending of the upper cylinder in correspondence of which the hide is comprised between the drying belt and its corresponding deflecting belt.

This situation is represented in FIG. 4 wherein it can be observed that the hide 10, in its advanced drying stage, forces against the inner section 54 of the deflecting belt 55, during the transit of said hide from the drying belt 51 to the underlying unloading belt 4, when it is wound around the upper cylinder 52 of the pair of expelling cylinders 53 belonging to the drying belt 51.

Therefore, in order to avoid the interference of the inner section 54 against the outer section 56, a stiff core 60 is placed between the two sections, said core acting as an element separating the two sections from the deflecting belt 55 and, besides absorbing and neutralizing the thrust of the hide 10, it also leads the latter to perform a normal return course until it places itself over the underlying belt.

When the hide reaches the lower part of the drying chamber, it is placed over the unloading belt, represented in FIG. 1 and indicated as a whole with 4, in correspondence of which is arranged the high-frequency unit 5 through which the hide transits before it is unloaded to the exterior.

It is in such a high-frequency unit 5 that the conditioning of the hide occurs and it is practically in this unit that the percentage of humidity which the hide will contain when it is unloaded from the drier is determined.

Moreover, such a unit has the purpose of making said humidity uniform all over the surface at a percentage value predetermined by the user.

Said high-frequency unit 5 essentially consists of a plurality of electrodes 24, arranged above and below in relation to the unloading belt 4 over which the hide 10 is placed, which are electrically connected to a high-frequency generator 25.

Said electrodes 24 produce then a high-frequency field which causes a friction heating of the molecules of the water contained in the hide, when the latter transits among the electrodes.

Since the power radiated by the electrodes 24 is proportional to the humidity being monitored, the intensity of the electric field is controlled so as to produce more or less evaporation of the water in the area of the hide containing a higher or lower quantity of humidity, respectively, and therefore a humidity uniformly distributed all over the hide is obtained.

It is possible, in other words, to obtain at the end of the drying treatment, a conditioned hide with a pre-determined percentage of humidity.

As a means for heating and dehumidifying the drying chamber 2, a mixed unit 6 is usefully used which foresees the use of a heating battery fed by a heating fluid, in combination with an improved heat pump unit being the object of the mentioned registered No. 93/00654 in the name of the same inventor.

The use of a mixed unit consisting of a heating battery and a heat pump for heating and dehumidifying allows to obtain considerable energy-savings and also a quicker drying.

It is a known fact that the percentage of humidity in the hide at the entrance of the drying chamber is about 50% and, in such conditions of humidity, the hide can be dried at a temperature oscillating between 50° and 60° C., without shrinkings of the fibres with losses in footage or with the classic curling up phenomenon occurring when the hides are dried at too-high temperatures.

In such conditions of humidity (50%) it is therefore convenient to dry the hide by means of a heating battery producing hot air, fed by any kind of heating fluid and thermoregulated by means of a control unit with feelers for monitoring the temperature and the humidity, so as to reduce the humidity contained in the hide up to a value corresponding to approximately 30%.

When the hide presents such conditions of humidity, it becomes convenient to proceed to the further drying until the hide has reached the final conditions so as to be conditioned at 10–12% of humidity, using a heat pump unit which, by drying and dehumidifying the hide itself at an operating temperature not exceeding 37° C., allows to obtain a good final quality of the hide, thus avoiding the already mentioned shrinkings of the fibres and the curling up phenomena and consequent losses in footage.

The heating and dehumidifying mixed unit represented in FIG. 5 and, as has been said, indicated as a whole with 6, comprises first heating and dehumidifying means, indicated as a whole with 121, and communicating with the first area 21 of the drying chamber, and second heating and dehumidifying means, indicated as a whole with 122, communicating with the second area 22 of the drying chamber itself.

It can be observed more in particular in FIG. 5 that said first heating and dehumidifying means 121 comprise a fan 123 which forces the air inside the first area 21 to circulate following direction 124, said air, when passing through a heating battery 125 fed by a heating fluid coming from the tube system 126, gets warm and runs through an set course following the direction of the fluid 127, skimming over the hides comprised between the drying belts 40 contained in said first heating and drying area.

In such a way, a forced evaporation of the water and a temperature decrease of the air which progressively becomes full of humidity, are produced.

The air temperature is kept constant, at a pre-determined value which is set on the electronic control unit 128, through the feeler 129 monitoring the temperature which, according to the temperature value being monitored and communicated to the control unit 128 through the connecting cable 130, controls the opening and closing of the valve 131 intercepting the tube system 126 feeding the heating fluid to the heating battery 125, said valve 131 being connected to the same electronic control unit 128 through the connection 132.

Therefore, according to the monitoring of the feeler 129, the control unit 128 controls the flow rates of the heating fluid in the heat-exchange battery 125, controlling the release of the heat rate so as to keep constant, as it has been said, the temperature of the air circulating inside the first area 21.

The humidity of the air is also kept constantly under control through the feeler 133, also connected to the control unit 128 through the conductor 134, which operates the opening or the closing of the gates 135 and 136.

In particular, when the humidity of the air inside the first area 21 exceeds the maximum pre-determined value and set in the control unit 128, the gates 135 and 136 are opened so that through gate 135 the saturated air is exhausted into the outside environment, while the air having less humidity enters from the outside environment through gate 136.

Said gates remain open for the time necessary to obtain through the air change, the previously set optimum working conditions inside the area 21.

Inside the first area 21 there is also another feeler 137 for monitoring the humidity of the hide, coming into contact with the hide itself and transmitting to another control unit 139 the humidity value being monitored through connection 138, and, should such a humidity value exceed a minimum pre-determined humidity value, said feeler slows down the feeding speed of the drying belts 40.

If, vice versa, the humidity being monitored is lower than the maximum pre-determined value, the speed of the drying belts 40 is accelerated.

It is then understood that, by combining the control actions of the first control unit 128 and of the second control unit 139 which keep under control the temperature and the humidity of both the hide and the environment, the proposed purpose is achieved, that is for the hide to enter into the second area 22 with a value of humidity strictly coinciding with the pre-determined value, which is the optimum for the hide to undergo to the second heating and dehumidifying phase by means of said second heating and dehumidifying means that, in this case, consist of the heat pump unit 122.

It can be observed that said unit 122 consists of a compressor 61, a heating battery 62 and a condensing battery 63, both of which are inserted in the cycle of the heat pump through the interposition of the heat exchangers 64 and 65 respectively. The interposition of such heat exchangers 64 and 65 has the purpose of insulating the circuit 66 of the compressor—wherein the refrigerating fluid, consisting of Freon for instance, flows -from the heat exchange circuits 67 and 68 of the condensing battery 63 and of the heating battery 62, respectively, where water circulates.

Thus, should the heating battery 62 and the condensing battery 63 be corroded by acids contained in the hides, which are brought into circulation during the drying treatment, it is possible to replace them by closing the intercepting valves 69 without intervening on the refrigerating circuit of the heat pump.

This is a considerable advantage since such a maintenance operation can also be performed by unskilled staff, while, were it otherwise, it would be necessary to ask for the intervention of personnel specialized in the refrigeration field.

In order to create air circulation, a fan 80 is foreseen which draws the air from the upper part 87 of the chamber. The air goes through the fan following the direction indicated by the arrows 81 and is conveyed into the underlying space and against the heating battery 62 following the direction indicated by the arrows 82.

In such an area the air recovers the heat that the compressor 61 produces during its operation and it also gets warmer when transiting through the heating battery 62. Such a heating battery 62 is connected through the circuit 68 with a second heat-exchanging element 101, belonging to the heat exchanger 64, which absorbs the heat being transferred to it by a first exchanging element 102, also belonging to the same exchanger 64 and connected in series to the circuit of the refrigerating fluid 66, which constitutes the condenser of the heat pump.

In such a first heat-exchanging element 102, the condensation of the refrigerating fluid circulating in the circuit 66 occurs, said fluid, by condensing, transfers the condensation heat to the second heat-exchanging element 101 and this in turn, transfers it to the heating battery 62 which warms the air let into the area 22.

The air thus heated enters following direction 83 into the area 22 where it rises toward the top following the direction indicated by the arrow 84 and passes through the drying belts following a winding direction.

Since the air entering into the lower part of the chamber is dry hot air, a part of it is conveyed following direction 183 inside the high-frequency unit 5, as can be observed in FIG. 5, wherein it helps the drying treatment of the hide during the conditioning phase.

When the air reaches the upper part 87 of the chamber, drawn by fan 80, it flows following direction 85 through the condensing battery 63 wherein it is cooled and dehumidificated through the condensing of the steam which it has accumulated during its course in the drying chamber, the resulting humidity falls by dripping into the receptacle 86 of the condensing battery 63.

In fact, such a condensing battery 63 is connected through the circuit 67 with a second heat-exchanging element 103, belonging to the heat exchanger 65, which transfers the heat to a first exchanging element 104, also belonging to the same exchanger 65 and connected in series to the circuit of the refrigerating fluid 66, which constitutes the steam condenser of the heat pump.

In such a first exchanging element 104, the evaporation of the refrigerating fluid circulating in the circuit 66 occurs, which, by evaporating, absorbs the heat from the second exchanging element 103 and this in turn absorbs it from the condensing battery 63 which cools and dehumidifies the air expelled from the drier.

The air thus dried is then sent following direction 82 into the lower chamber wherein there is the compressor 61 and it resumes its closed-circuit circulation, as previously described.

According to what has been described, it is then understood how the improved drier according to the invention achieves the proposed purpose i.e. the shortening of the drying times of the hides, while also reducing the consumption of energy.

It has been seen that this is obtained by using a mixed unit for heating and dehumidifying which foresees the use of a heating battery producing hot air in combination with a heat pump.

It has also been seen that such a combination keeps the quality of the hide constant after the drying treatment. During the manufacturing treatment the drier according to the invention may undergo some changes in order to improve or to simplify its manufacture or with the purpose of improving its operation.

The inlet belt of the drier for instance, could be arranged at different slanting angles according to the requirements of the user.

With regard also to the heating unit with heating battery producing hot air, it can consist of one or more heating batteries and one or more fans, according to the requirements or particular needs of the product or the user.

All said possible modifications and variations still fall within the scope and spirit of the present invention.

What is claimed is:

1. A drier for the continuous drying and conditioning treatment of hides or fabrics comprising:

a loading unit including a plurality of belts suited to convey the product to be treated inside a drying chamber;

a drying chamber within which there is a plurality of drying belts, suited to receive the material conveyed by the loading unit;

an unloading belt which conveys the material outside the drier once the treatment has been completed;

means for dehumidifying and conditioning the product, wherein said drying chamber is subdivided into a first area communicating with first means for heating and dehumidifying the air circulating in said first area and into a second area communicating with second means for heating and dehumidifying the air circulating in said second area comprising a heat pump including a compressor for maintaining refrigerating fluid in circulation within a closed circuit connected both with a condensing battery, through which humid air is circulated and dehumidified, and with a heating battery, through which dry air is circulated and heated before entering the second area.

2. A drier according to claim 1, wherein said first means for heating and dehumidifying the air circulating in said first area of said drying chamber, consist of a fan for the circulation of the air inside said first area and a heating battery fed by a heating fluid and suited to heat said air kept in circulation by said fan.

3. A drier according to claim 1, wherein said first area of said drying chamber communicates with the outside environment through adjustable gates, wherein the opening of said gates is controlled by a control unit according to the humidity and the temperature conditions monitored in the air inside said first area by feelers connected to said control unit.

4. A drier according to claim 1, wherein each battery is connected to the circuit of the refrigerating fluid through at least one heat-exchanger provided with first heat-exchanging elements connected in series to the circuit of the refrigerating fluid which perform the heat exchange with second heat-exchanging elements connected with their corresponding battery with which they form another closed circuit separated from the circuit of the refrigerating fluid.

5. A drier according to claim 4, wherein the first heat-exchanging element belonging to each heat-exchanger corresponding to each condensing battery, is the steam condensing element wherein the evaporation of the refrigerating fluid occurs.

6. A drier according to claim 4, wherein the first heat-exchanging element belonging to each heat-exchanger corresponding to each heating battery, is the condensing element wherein the condensation of the refrigerating fluid occurs.

7. A drier according to claim 1, wherein said belts which form said loading unit comprise an inlet belt on which the product to be treated is placed and a feeding belt facing a feeding counter-belt, both of them arranged in an essentially slanted position, between which is placed the product to be treated which they receive from the inlet belt.

8. A drier according to claim 1, wherein said drying belts contained in said drying chamber comprise a first drying belt facing a drying counter-belt placed above it, both of them arranged in an essentially horizontal position and suited to receive the material conveyed by said loading unit and a plurality of other drying belts overlying one another underneath said first drying belt, wherein each of said belts receives the material from the previous belt and deflects it to the next belt.

9. A drier according to claim 8, wherein in correspondence with the expelling end, each drying belt faces a deflecting belt wound in the shape of a closed ring around at least a group of three cylinders of which at least one is motorized, wherein said deflecting belt guides the product under treatment and keeps it adhering to the drying belt when it is transiting from one drying belt to the underlying drying belt.

10. A drier according to claim 9, wherein in each deflecting belt there is a deflecting stiff core interposed between the two sections which form the deflecting belt.

11. A drier according to claim 7, wherein the feeding counter-belt is kept adhering to the feeding belt through pressure elements which are arranged by gravity on the surface of the feeding counter-belt and are bound to the loading unit in correspondence with its upper and lower ends.

12. A drier according to claim 1, wherein the means for heating and dehumidifying the product are at least a high-frequency unit consisting of a plurality of electrodes electrically connected to a high-frequency generator through which the hide transits.

13. A drier according to claim 11, wherein the pressure elements are a plurality of elastic ribbons.

14. A drier according to claim 11, wherein the pressure elements are a plurality of chains.

15. A drier for product comprising:

a drying chamber divided into first and second areas;

a loading unit including loading belt means in communication with the first area for carrying product into said drying chamber;

conveying belt means in communication with the loading belt means for receiving product therefrom and conveying the product through the drying chamber from the first area and into the second area;

unloading belt means in communication with the conveying belt means in the second area for conveying product externally thereof when drying is completed;

first means in communication with the first area for heating and dehumidifying air in said first area and into said second area; and second means comprising a heat pump including a compressor for compressing a refrigeration fluid, a closed circuit path for containing said refrigeration fluid in flow communication with the compressor, a condensing battery for receiving humidified air from the second area and being in heat exchange relation with the closed circuit for dehumidifying said air, and a heating battery in heat exchange relation with the closed circuit and in flow communication with the condensing battery and the second area for receiving and heating the dehumidified air from the condensing battery before entry into the second area.

* * * * *